United States Patent [19]

Williams

[11] 4,386,619

[45] Jun. 7, 1983

[54] HAIR HAIR-ENHANCING CAP

[76] Inventor: Raymond F. Williams, 32130 Plymouth Rd., Livonia, Mich. 48150

[21] Appl. No.: 314,802

[22] Filed: Oct. 26, 1981

[51] Int. Cl.[3] ..... A41G 3/00

[52] U.S. Cl. ..... 132/53

[58] Field of Search ..... 132/9, 53, 54

[56] References Cited

U.S. PATENT DOCUMENTS

| | | | |
|---|---|---|---|
| 1,442,094 | 1/1923 | Pruitt | 132/53 |
| 3,444,865 | 5/1969 | De Vita | 132/53 |
| 3,474,767 | 10/1969 | Ito | 132/53 |
| 3,586,009 | 6/1971 | Sirmons | 132/9 |
| 3,734,105 | 5/1973 | Borghese | 132/53 |

*Primary Examiner*—Gregory E. McNeill

*Attorney, Agent, or Firm*—Reising, Ethington, Barnard, Perry, Brooks & Milton

[57] ABSTRACT

A hair-enhancing cap including netting comprised of a tough wire-like elastic synthetic material and including an outer member, a plurality of supporting members secured to the outer member and a plurality of inner members secured between the outer member and the supporting members. The netting of the cap defines a plurality of openings in the cap and includes an elastic fastener secured to the outer member which holds the outer member under tension. The cap also includes natural or synthetic hair secured to the netting of the cap. The cap is positioned on the head over the existing hair and conforms to the natural contour of the head being held in place by the tension in the outer member. The existing hair is drawn through the openings defined by the netting of the cap and combined with the hair secured to the netting thereby obscuring the netting from sight beneath the combination of the existing hair and the hair secured to the netting. The hair secured to the netting, being generally of a different color than the existing hair, creates a frosting effect within the existing hair.

9 Claims, 6 Drawing Figures

HAIR HAIR-ENHANCING CAP

BACKGROUND ART

This invention relates generally to hairpieces, and is particularly concerned with hairpieces which provide additional hair to enhance existing hair but are not used as a substitute for the existing hair. The invention provides additional hair of a different color which, when combined with the existing hair, creates a frosting effect within the existing hair.

Individuals often find it desirable to highlight or enhance their existing hair by introducing hair of a different color within their existing hair. This is generally achieved by dying or bleaching strands of the existing hair to a different color whereby the strands of hair run through the existing hair and create a frosting effect.

The general method used to dye or bleach strands of hair without changing the color of all the existing hair is achieved by placing a rubberized swimming-type cap containing numerous small openings or holes over the head. The existing hair is drawn through the small openings with a small hook or similar instrument and are then dyed or bleached individually such that the dye or bleach does not contact the bulk of the existing hair.

There are several problems with this method. One problem is that the pulling of the hair through the small openings in the cap is very painful and requires a great deal of time. An additional problem is that the harsh chemicals used to bleach or dye can cause severe reactions and irritation to the scalp.

Individuals who have strong reactions to the bleaches and dyes are not able to achieve a frosting effect within their existing hair with this method.

Furthermore, the bleaching or dying of the hair is only temporary and to maintain the color of the strands this method must be repeated every few months.

Finally, once the strands are dyed or bleached a different color, it requires a great deal of time for the natural hair color to grow out if the original color is again desired.

In general, therefore, it can be said that the current method for achieving a frosting effect within the existing hair is painful, time consuming and not readily reversible.

DISCLOSURE OF THE INVENTION

An object of this invention is to provide a frosting effect within the existing hair without the introduction of any bleaches, dyes or harsh chemicals and which achieves this effect without being painful, irritating or time consuming.

A further object is to provide a hair piece which allows for the frosting of the existing hair whereby the frosting effect can be added or removed as the wearer desires.

In carrying out the foregoing, and other objects, a frosting cap according to the present invention includes netting comprised of a tough elastic synthetic material such as nylon, and includes an outer member, a plurality of supporting members secured to the outer member and a plurality of inner members secured between the outer member and the supporting members.

The netting defines a plurality of openings in the cap and includes an elastic fastener secured to the outer member which holds the outer member under tension. The cap further includes hair of any length or color, either natural or synthetic, secured to the netting of the cap.

In accordance with the invention, the cap is positioned on the head over the existing hair and is held in place by the tension in the outer member. The cap, being comprised of a tough wire-like elastic synthetic material, conforms to the natural contour of the head. The existing hair may be drawn through the openings of the cap and combined with hair secured to the netting thereby obscuring the netting from sight beneath the combination of the existing hair and the hair secured to the netting.

The hair secured to the netting may be of a different color than the existing hair thereby creating a frosting effect within the existing hair.

The hair may also be of the same color as the existing hair creating a filling effect within the existing hair.

Other objects, advantages and features of the invention will become apparent from the following description taken in connection with the accompanying drawings.

BEST MODE FOR CARRYING OUT THE INVENTION

Figure 1:
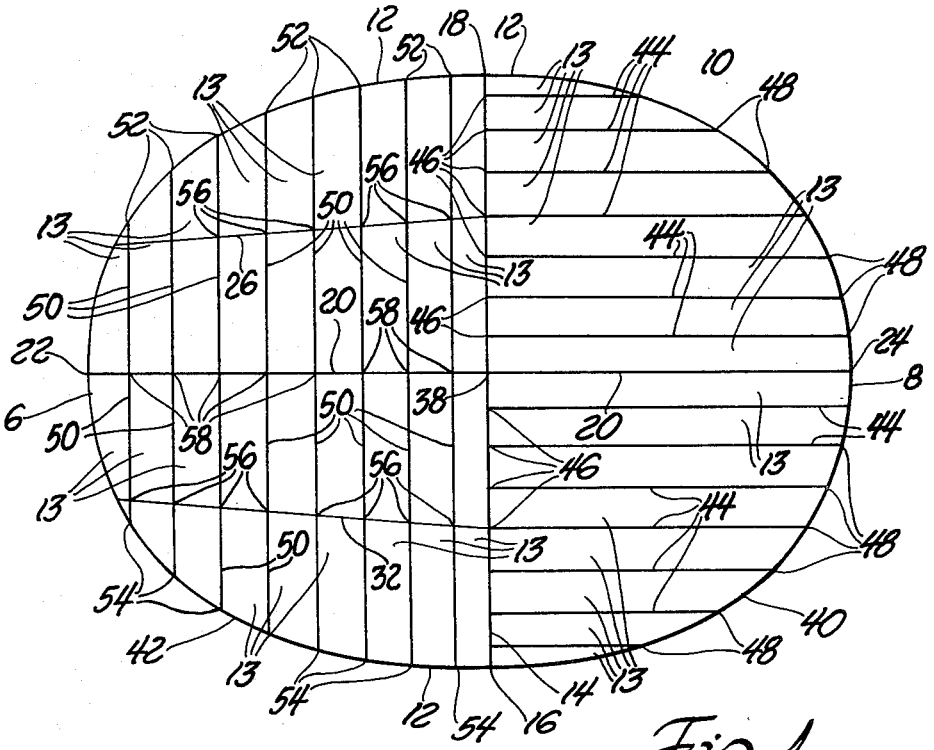
FIG. 1 is a top elevation view of the netting of the cap.

Referring to FIG. 1 of the drawings, a hair-enhancing cap, generally indicated by reference numeral 10, is comprised of netting 11, which defines openings 13 and includes an outer member 12 defining the periphery of the cap 10.

The cap 10 includes a front end, generally 8, and a back end, generally 6, which generally relates to the orientation of the cap 10 on the head.

The cap 10 further includes a first supporting member 14 with opposite ends 16 and 18 respectively, secured to the outer member 12. The first supporting member 14 is located approximately midway between the front end 8 and back end 6 of the cap 10.

The cap 10 also includes a second supporting member 20 with outer ends 22 and 24 respectively, secured to the outer member 12. The second supporting member 20 extends from the front end 8 to the back end 6 of the cap 10.

Figure 2:
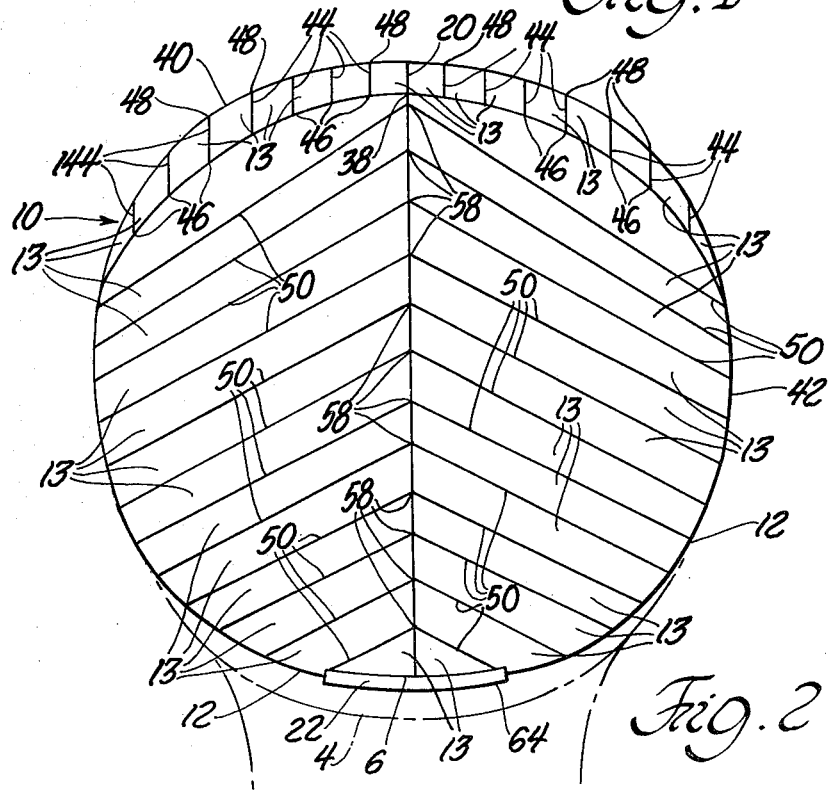
FIG. 2 is a rear elevation view of the netting of the cap.
Figure 3:
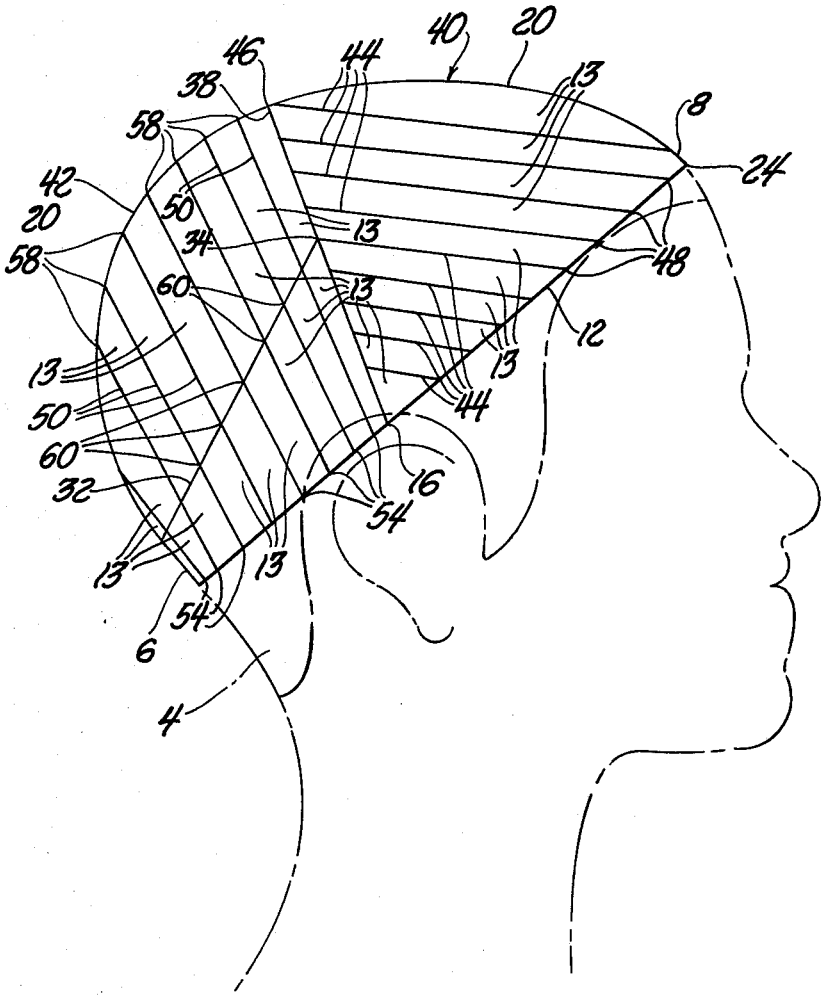
FIG. 3 is a side elevation view of the netting of the cap.

Referring to FIGS. 1–3, the cap also includes a third supporting member 26 with opposite ends 28 and 30 respectively, and a fourth supporting member 32 with opposite ends 34 and 36 respectively. The third supporting member 26 has one end 28 secured to the first supporting member 14 and the other end 30 secured to the outer member 12. The fourth supporting member 32 has one end 34 secured to the first supporting member 14 and the other end 36 secured to the outer member 12.

The third supporting member 26 and the fourth supporting member 32 are located on opposite sides of the second supporting member 20 and run in a direction which is generally from the back end 6 towards the front end 8 of the cap 10.

The first supporting member 14 is secured to the second supporting member 20 at a point 38 located on the first supporting member 14 and second supporting member 20.

The cap 10 can be generally characterized as including a front half 40, which extends from the first supporting member 14 to the front end 8 of the cap 10, and a back half 42, which extends from the first supporting member 14 to the back end 6 of the cap 10.

The front half 40 of the cap 10 is comprised of a plurality of inner members 44 with a plurality of opposite ends 46 and 48, respectively. Ends 46 of the front half members 44 are secured to the first supporting member 14 while the opposite ends 48 of the first half members 44 are secured to the outer member 12.

The front half members 44 run from the first supporting member 14 to the front end 8 of the cap 10 in a direction which is generally parallel to the direction of the second supporting member 20.

The back half 42 of the cap 10 also includes a plurality of inner members 50 with a plurality of opposite ends 52 and 54, respectively. Ends 52 of the back half members 50 are secured to the outer member 12 on one side of the second supporting member 20, while the opposite ends 52 of the back half members are secured to the outer member 12 on the opposite side of the second supporting member 20.

The back half members 50 are located between the back end 6 of the cap 10 and the first supporting member 14 and are oriented in a direction generally parallel to the direction of the first supporting member 14.

The back half members 50 are also secured to the third supporting member 26, the second supporting member 20 and the fourth supporting member 32 at points 56, 58 and 60 respectively as shown in FIG. 1. The cap 10 also includes an elastic fastener 64 as shown in FIG. 2. The elastic fastener 64 is located at the back end 6 of the cap 10 and is secured to the outer member 12 of the netting 11. The elastic fastener 64 holds the outer member 12 under tension.

The netting 11 with outer member 12, supporting members 14, 20, 26 and 32, and inner members 44 and 50 are all comprised of a tough wire-like elastic synthetic material such as nylon. In its preferred construction the netting 11 is comprised of clear nylon.

Figure 4:
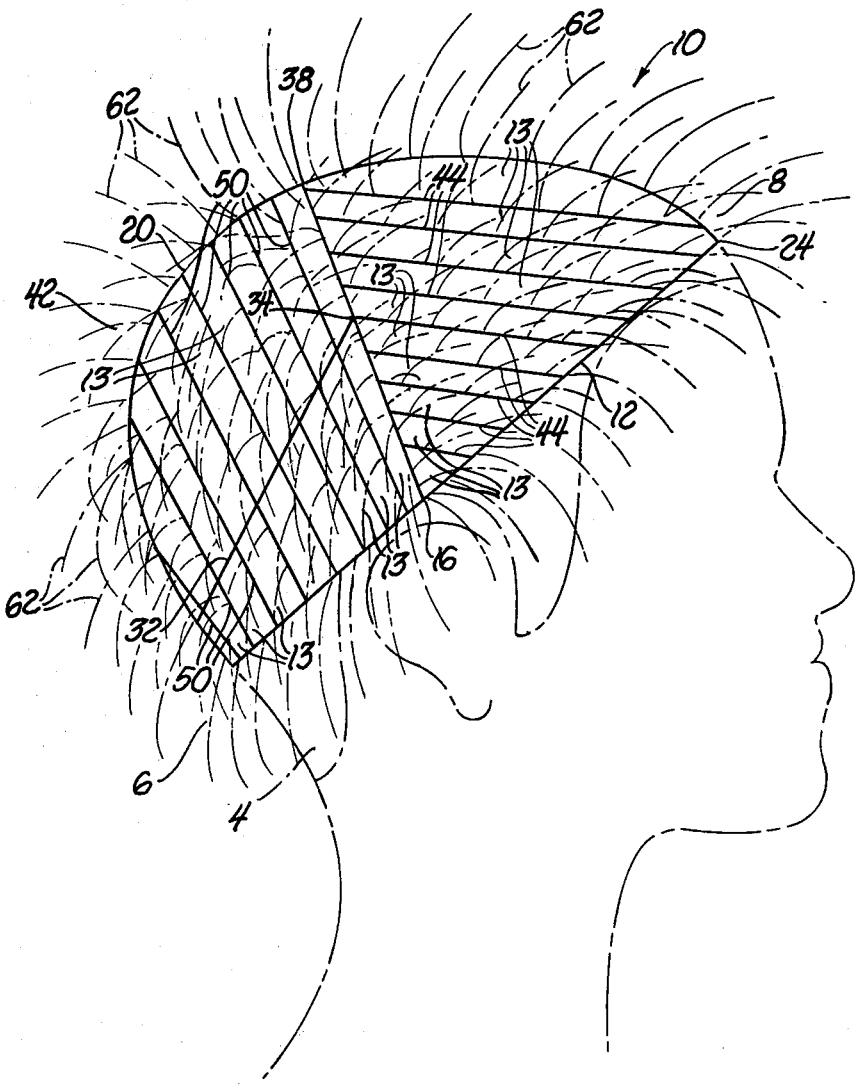
FIG. 4 is a side elevation view of the cap with hair secured to the netting.

The cap 10 further includes hair 62 as shown in FIG. 4 which is secured to the netting 11 of the frosting cap 10. The hair 62 may be comprised of natural hair or synthetic fibers such as ELEURA, DYNAL or KANE KAION, and may be of any length or color.

To achieve the desired frosting effect, the cap 10 is positioned on the head over the existing hair 4 and held in place by tension in the outer member 12. The tough elastic synthetic material of the netting 11 conforms the cap 10 to the natural contour of the head.

Once the cap 10 is in position, the existing hair 4 is drawn through the openings 13 of the netting 11 by brushing or combing. The existing hair 4 is then combined with the hair 62 secured to the netting 11 of the cap 10 and the combined hair 66 is then combed or brushed into place with netting 11 being obscured from sight beneath the combined hair 66.

When the hair 62 secured to the netting 11 is the same color as the existing hair 4, the use of the cap 10 creates a filling effect within the existing hair 4.

When the hair 62 secured to the netting 11 of the cap 10 is of a different color than the existing hair 4, a frosting effect is created within the existing hair 4.

Figure 5:
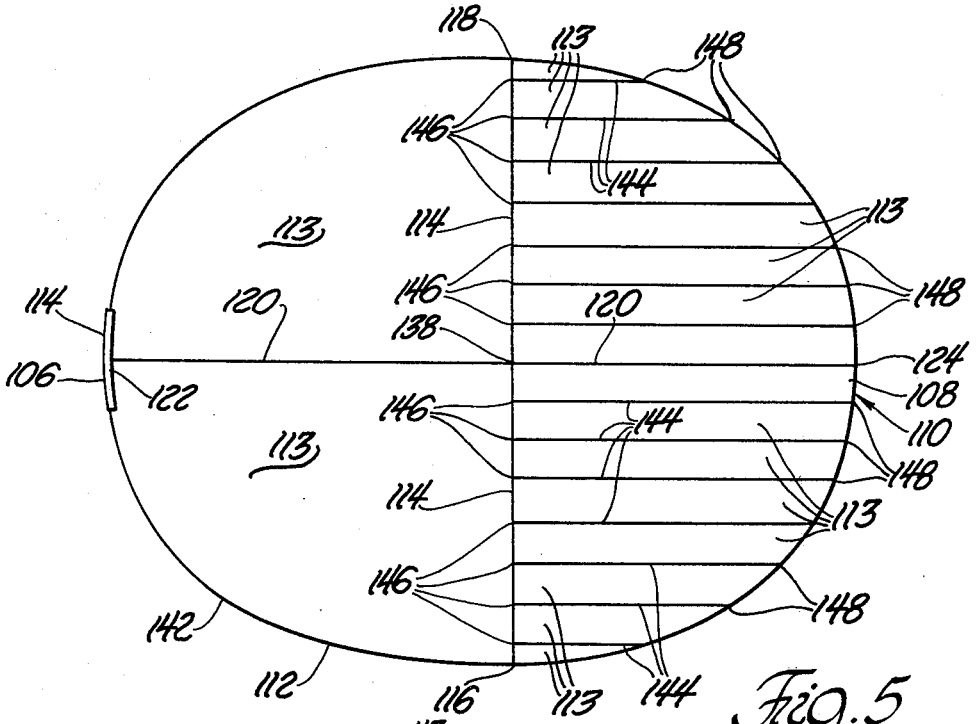
FIG. 5 is a top elevation view of the netting of the cap in other embodiment.

Referring to FIG. 5 of the drawings, a frosting cap 110 is shown in another embodiment.

The cap 110 in FIG. 5 also includes a front end, generally 108 and back end, generally 106, which generally relates to the orientation of the cap 110 on the head.

The cap 110 is comprised of netting 111 which defines openings 113 and includes an outer member 112 defining the periphery of the cap 110.

The cap 110 further includes a first supporting member 114 with outer ends 116 and 118 respectively, secured to the outer member 112. The first supporting member 114 is located approximately midway between the front end 108 and back end 106 of the cap 110.

The cap 110 also includes a second supporting member 120 with outer ends 122 and 124 respectively, secured to the outer member 112. The second supporting member 120 extends from the front end 108 to the back end 106 of the cap 110.

The first supporting member 114 is secured to the second supporting member 120 at a point 138 located on the first supporting member 114 and the second supporting member 120.

The cap 110 can be generally characterized as including a front half 140, which extends from the first supporting member 114 to the front end 108 of the cap 110, and a back half 142, which extends from the first supporting member 114 to the back end 106 of the cap 110.

The front half 140 of the cap 110 is comprised of a plurality of inner members 144 with a plurality of opposite ends 146 and 148, respectively. Ends 146 of the front half members 144 are secured to the first supporting member 114 while the opposite ends 148 of the first half members 144 are secured to the outer member 112.

The front half members 144 run from the first supporting member 114 to the front end 108 of the cap 110 in a direction which is generally parallel to the direction of the second supporting member 120.

Figure 6:
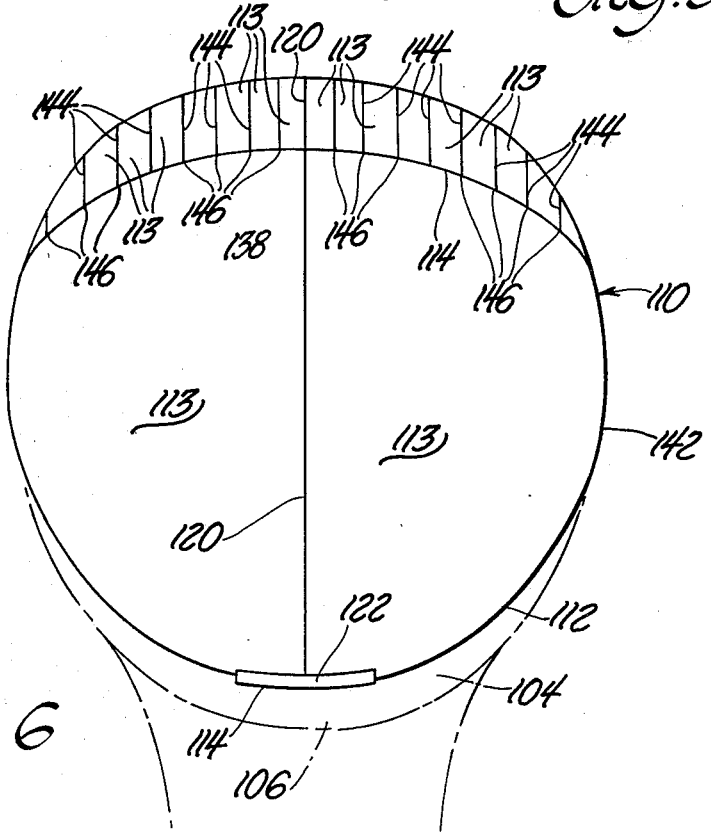
FIG. 6 is a rear elevation view of the netting of the cap of FIG. 5.

The cap 110 also includes an elastic fastener 164 as shown in FIGS. 5 and 6. The elastic fastener 164 is located at the back end 106 of the cap 110 and is secured to the outer member 112 of the netting 111. The elastic fastener 164 holds the outer member 112 under tension.

The netting 111 with outer member 112, supporting members 114 and 120, and inner members 144 are all comprised of a tough elastic synthetic material such as nylon. In its preferred construction the netting is comprised of clear nylon.

The cap 110 further includes hair 162 as is shown in FIG. 4 and which is also secured to the netting 111 of the frosting cap 110. In this embodiment however, the hair 162 is only secured to the front half 140 of the cap 110. The hair 162 may be comprised of natural hair or synthetic fibers such as ELEURA, DYNAL or KANE KAION, and may be of any length or color.

The cap 110 as shown in this embodiment, is also positioned on the head over the existing hair 104 and held in place by tension in the outer member 112.

Once the cap 110 is in position the existing hair 104 is drawn through the openings 113 of the netting 111 by brushing or combing. The existing hair 104 is then combined with the hair 162 secured to the front half 140 of the cap 110 and the combined hair 166 is then combed or brushed into place with the netting 111 being obscured from sight beneath the combined hair 166.

In this embodiment, as hair 162 is only secured to the front half 140 of the cap 110 the frosting or filling effect previously described is limited to the front of the existing hair 104.

While specific modes for carrying out the invention have herein been described in detail, those familiar with the art to which this invention relates will recognize various alternative designs and embodiments for carrying out the invention as defined by the following claims.

What is claimed is:

1. A cap for enhancing the existing hair of the wearer, said cap comprising: netting comprised of a plurality of thin, elongated strands of a tough wire-like elastic synthetic material that can be covered and obscured by the hair of the wearer; said netting including an outer member defining the periphery of the cap, a plurality of supporting members secured to said outer member and a plurality of inner members secured between said outer member and said supporting members; the thin, elongated strands of said netting being spaced apart and defining a plurality of openings in said cap; an elastic fastener secured to said outer member; said fastener holding said outer member under tension; hair secured to the netting of said cap; said cap being positioned on the head over the existing hair and being held in place by tension in the outer member with the netting of said cap conforming to the natural contour of the head; and wherein the existing hair is drawn through the openings in the cap and combined with the hair secured to the netting thereby obscuring the netting from sight beneath the combination of the existing hair and the hair secured to the netting.

2. A cap as in claim 1 wherein the netting comprises clear nylon.

3. A cap as in claims 1 or 2 wherein said hair is comprised of synthetic fibers.

4. A cap as in claim 3 wherein said hair comprises ELEURA.

5. A cap as in claim 3 wherein said hair comprises DYNAL.

6. A cap as in claim 3 wherein said hair comprises KANE KAION.

7. A cap as in claims 1 or 2 wherein said hair is comprised of human hair.

8. A cap as in claims 1 or 2 wherein the hair secured to said netting is the same color as the existing hair creating a filling effect within the existing hair.

9. A cap as in claims 1 or 2 wherein the hair secured to said netting is of a different color than the existing hair creating a frosting effect within the existing hair.

* * * * *